US008668407B2

(12) United States Patent
Hawkins et al.

(10) Patent No.: US 8,668,407 B2
(45) **Date of Patent: *Mar. 11, 2014**

(54) DOCKING SYSTEM WITH JOINT SUPPORTS

(75) Inventors: Harold Hawkins, Atlanta, GA (US); Timothy Osby, Atlanta, GA (US); Michael Lyle, Gainesville, GA (US)

(73) Assignee: Wahoo Docks, Gainesville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/419,133

(22) Filed: Mar. 13, 2012

(65) Prior Publication Data

US 2012/0167518 A1 Jul. 5, 2012

Related U.S. Application Data

(63) Continuation of application No. 12/871,522, filed on Aug. 30, 2010, now Pat. No. 8,157,480, which is a continuation of application No. 11/928,015, filed on Oct. 30, 2007, now Pat. No. 7,806,630.

(51) Int. Cl.
*E02B 3/20* (2006.01)

(52) U.S. Cl.
USPC ..... 405/218

(58) Field of Classification Search
USPC ..... 405/218, 219, 220, 221
See application file for complete search history.

(56) References Cited

U.S. PATENT DOCUMENTS

| | | | | | |
|---|---|---|---|---|---|
| 2,592,626 | A * | 4/1952 | Wanless | 405/218 |
| 4,352,597 | A * | 10/1982 | Kay | 405/219 |
| 4,581,784 | A * | 4/1986 | Rousseau et al. | 405/219 |
| 4,645,380 | A * | 2/1987 | Hambrick et al. | 405/220 |
| 5,199,371 | A * | 4/1993 | Meriwether | 405/219 |
| 5,788,416 | A * | 8/1998 | Wolgamot | 405/218 |
| 6,431,794 | B1 * | 8/2002 | Zweber | 405/221 |
| 6,648,554 | B1 * | 11/2003 | Sehl | 405/219 |
| 7,806,630 | B2 * | 10/2010 | Hawkins et al. | 405/220 |
| 8,157,480 | B2 * | 4/2012 | Hawkins et al. | 405/218 |
| 2004/0009043 | A1 * | 1/2004 | Sehl | 405/218 |
| 2007/0077127 | A1 * | 4/2007 | Berlin | 405/220 |

* cited by examiner

*Primary Examiner* — Frederick L Lagman
(74) *Attorney, Agent, or Firm* — Smith Risley Tempel Santos; Gregory S. Smith; Matthew T. Hoots

(57) ABSTRACT

A set of components that can be used to construct a structurally sound dock are disclosed. The components can be extruded and the components are shaped such that interconnected components provide support for the other components thereby alleviating weak points due to welded only joints. A fascia channel provides additional strength by including structures that improve the vertical and horizontal strength of the fascia channel. HDPE plastic inserts and sheaves provide sound dampening for metal to metal contact points. Other components include a corner connector, a post system and a hinge system.

17 Claims, 8 Drawing Sheets

DOCKING SYSTEM WITH JOINT SUPPORTS

CROSS-REFERENCE TO RELATED APPLICATIONS

This United States Non-provisional application is being filed under 35 USC 111 and 37 CFR 1.53(b) and is a continuation of, and is claiming the benefit of the priority date of, U.S. Pat. No. 8,157,480, filed on Aug. 30, 2010 and assigned application Ser. No. 12/871,522 which is a continuation of, and claimed the benefit of the priority date of, U.S. Pat. No. 7,806,630, filed on Oct. 30, 2007 and assigned application Ser. No. 11/928,015. Each of U.S. Pat. No. 8,157,480 and U.S. Pat. No. 7,806,630 is incorporated herein by reference.

BACKGROUND OF THE INVENTION

Just three days before he died in a plane crash outside of Madison, Wis., Otis Redding recorded the number one hit "The Dock of the Bay" about a person that was fed up with a hectic life in Georgia and traveled to the San Francisco Bay to just sit on a dock. There is just something alluring about docks, some element that captivates our attention, draws us in, and triggers some distant emotion that is embedded deeply within. The allure may be tied to the merging aspect of a dock that allows us to move from land to sea, to experience the water from a more intimate perspective. However, I don't think anyone can really put their finger on exactly what it is, although many have spoken of this allure through song, poetry, paintings and other forms of art. In fact, if you do a GOOGLE search on "poetry about docks" you find more than 1.2 million hits.

So, whether you have left your home in Georgia and are "sittin' on the dock of the bay watching the tide roll away, watching the ships roll in", simply "wastin' time", hosting a barbeque or securing your boat down for the evening, there are certainly things that are important about your dock. One such matter of importance is that you generally don't want your experience of the water to include falling into the water as the deck collapses. More specifically, in constructing docks, especially those that are accessible to the public, safety and longevity are of utmost concern. Unlike Darwin's theory that chaos moves towards order, items that are constructed, such as docks, decks, etc, generally decay or degrade over time due to wear-and-tear, weather stress, use stress, rust, or the like. As a result, a dock that may have originally been constructed in accordance with stringent safety requirements, may deteriorate to a point at which the dock is simply unsafe. To prevent such deterioration, the dock should be periodically maintained. However, it is desirable to construct docks and other items in a manner that maintains the structural integrity and safety with a minimum amount of maintenance or up keep.

One of the developments in industry that addresses this need in the art was the application of aluminum in the construction of docks and decks. Aluminum is truly the ideal structural material for dock systems. Aluminum demonstrates excellent weathering characteristics as a result of its rust prohibiting properties and exceptional structural strength. This combination of properties virtually eliminates maintenance and greatly increases the longevity of a dock or deck. Moreover, when used for decking, aluminum flooring is cool to the touch and splinter free. Thus, aluminum docks never require sanding, sealing, staining or painting.

When building a dock or a deck out of wood, the required building blocks are readily accessible in most large scale home improvement centers such as LOWES or HOME DEPOT. The supply of treated two-by-fours, four-by-fours, six-by-sixes, one-by-six planks, etc., can be easily purchased and cut as necessary to construct the dock or deck. However, to construct a dock or deck out of aluminum components is a different story. Unlike the lumber industry, there are no standard building blocks that are readily available for constructing such a structure out of aluminum. Further, working with aluminum is completely different than working with lumber. Working with aluminum requires different tools and most likely even requires welding. All of these factors have tended to remove aluminum construction from the hands of the typical do-it-yourself handy-man. What is needed in the art is a technology that enables the construction of aluminum structures, such as decks and docks in a manner that is safe, efficient and structurally sound. In addition, it is desirable for such a solution to also include a standard set of components that can be easily inventoried in a supply store without overwhelming the retail companies with larger number of components. Furthermore, it is desirable for such a solution to enable the do-it-yourself handy-man to build a structure out of aluminum.

Although aluminum is easy to work with in many aspects, such as tooling, drilling, etc., it also has disadvantages when it comes to welding. The main disadvantage, which is well known to those skilled in the art, is that the process of welding decreases the tensile strength in aluminum. In some instances, a post-heating treatment can be used to restore some of the lost tensile strength but, such a process is not feasible in a construction environment. As such, welded joints of aluminum components have a greatly diminished strength, usually about half of the tensile strength of the remaining, non-welded portions of a structure. Thus, there is a need in the art for a technique to help improve the strength of welded joints for aluminum components, especially in docking or decking structures in which much stress is placed on the welded joints.

BRIEF SUMMARY OF EMBODIMENTS OF THE INVENTION

The present invention is directed towards a componentized dock construction system that, with a limited number of components, one can construct a solid, safe and structurally sound dock, deck or other structure. Various embodiments of the invention may include a fascia channel, a corner connector, a post system and a hinge system.

More specifically, one embodiment of the present invention is a structure constructed of various components. The components include one or more fascia channels, one or more corner connectors and one or more post systems. The fascia channels include a main vertical wall, a lower horizontal unit, and an upper horizontal unit. Each of these elements cooperatively define a channel that runs the length of the fascia channel. In one embodiment, the fascia channel provides additional structural support by the lower horizontal unit and the upper horizontal unit included horizontal and vertical components. The components not only provide strength to the fascia channel but they also provide support for other components.

The corner connectors include a post receptacle and two support inserts. The support inserts are integral to a corner connector with each support insert having a second cross-sectional shape that has an exterior shape that can be received into the interior of the channel of the one or more fascia channels. The corner connector also includes a post receptacle.

The post system includes a post and a plurality of inserts. The post is placed into the post receptacle of the corner connector along with the inserts. Advantageously, the inserts dampen any noise generated by the post and the post receptacle coming into contact with each other. Using these components, a platform can easily be constructed.

Multiple platforms can be interconnected in a flexible manner by employing the hinge system. The hinge system includes a plurality of platform mounts and a plurality of hinge mounts that are mounted on two platforms or structures to be connected. A hinge pin is used to secure the structures together in a piano hinge type of connection. Further, in some embodiments, the platform mounts may include a stop that prevents pivoting of the hinge beyond a particular point. However, it will be appreciated that the platforms can also be connected by bolting or otherwise affixing the platforms to each other in a non-hinged manner.

These and other aspects, features and embodiments of the present invention are presented further in the detailed description of various embodiments of the invention.

DETAILED DESCRIPTION OF EMBODIMENTS OF THE INVENTION

The present invention addresses the above-listed needs in the art, as well as other needs by providing a system of components that can be used to construct docks, decks or other similar structures. In one embodiment of the invention, the components are fabricated from aluminum. One aspect of the present invention is that the components are structured such that when joined together, not only do they provide an good joint for welding and an area for receiving a bolted or riveted connection, but they also provide structural integrity above and beyond the welding, bolting and/or riveting. More specifically, one advantage of various embodiments of the invention, as will be further described, the components provide structural support for each other to overcome the weakening affect that arises due to welding joints in aluminum construction.

Another advantage of the present invention is that not only can the components be constructed from cast aluminum, but they can also be extruded which provides additional strength and integrity in the constructed structure. Another aspect of the present invention is that a limited number of standardized components can be used to build a variety of structures. Thus, advantageously, the components can be stocked in a building materials store without requiring excessive shelf space.

Turning now to the figures in which the various features, aspects and elements included in embodiments of the invention are illustrated, such embodiments will be further described.

Figure 1A:
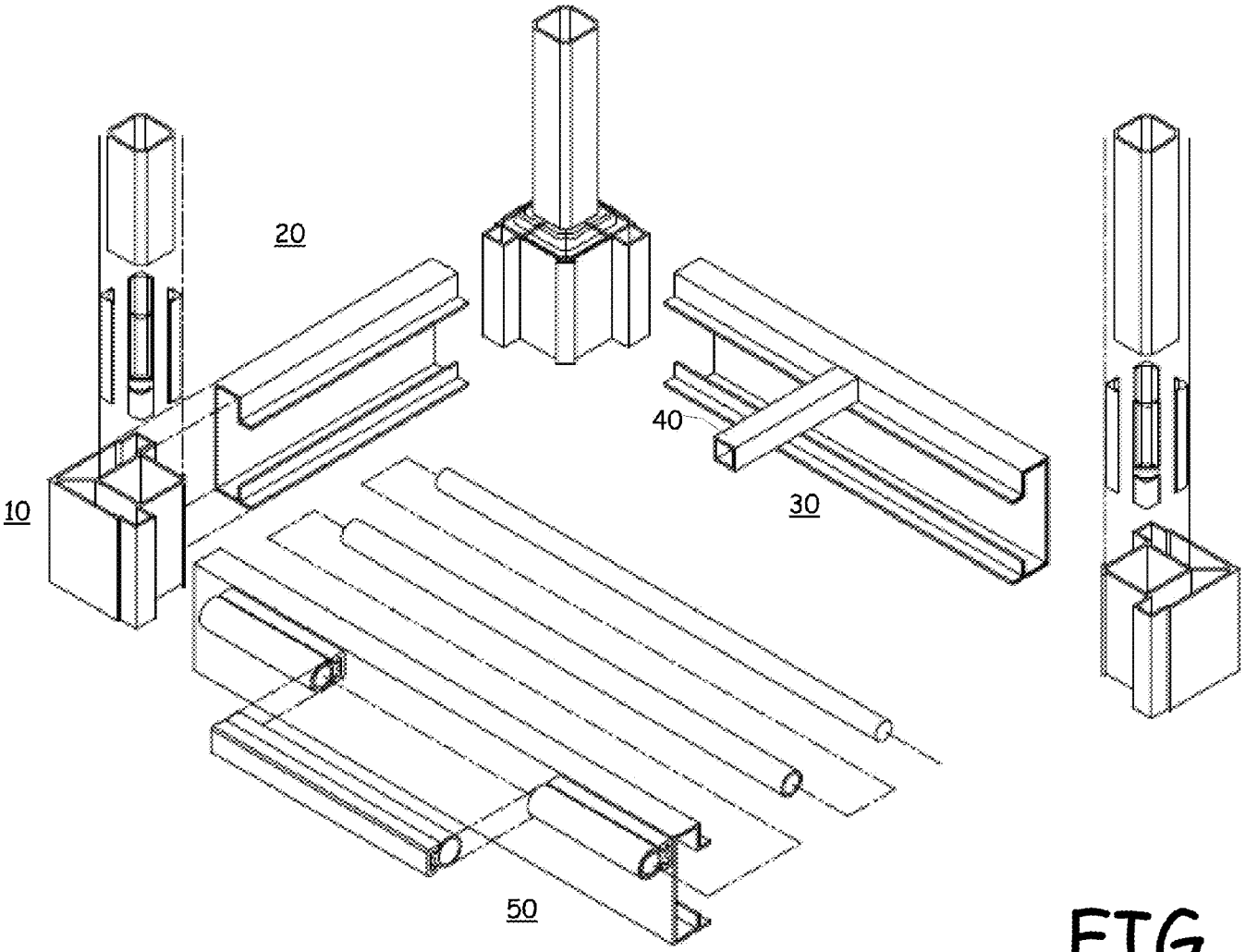
FIG. 1A is an exploded view illustrating various components that are included in an exemplary embodiment of the docking system.

FIG. 1A is an exploded view illustrating various components that are included in an exemplary embodiment of the docking system. The illustrated components include a corner connector 10, a post system 20, a fascia channel 30, and a hinge system 50. A docking platform can be constructed from the components illustrated in FIG. 1A in a variety of configurations. For instance, a rectangular shaped platform can be constructed by using four corner connectors 10 joined together by four lengths of fascia channels 30. The platform can be raised to a desired height using the post system 20 at each corner connector 10 and/or the post system 20 can be used to support another platform or roof structure above the platform. In addition, two platforms can be joined together either rigidly or by using the hinge system 50. In a floating dock system, various platforms can be interconnected with the hinge system 50 to allow the platforms to rock with the water movements. For platforms with a longer span, expanses of the fascia channel 30 can be joined together by another embodiment of the corner connector that actually connects fascia channels in line with each other or, a fascia support element similar to a corner connector but rather as an in-line component may be used to achieve a similar result. As illustrated, the fascia channels 30 may include a lip or support for receiving a plurality of beams, such as 2×2 support beams that may form the floor or roofing of a platform or support the flooring.

Figure 1B:
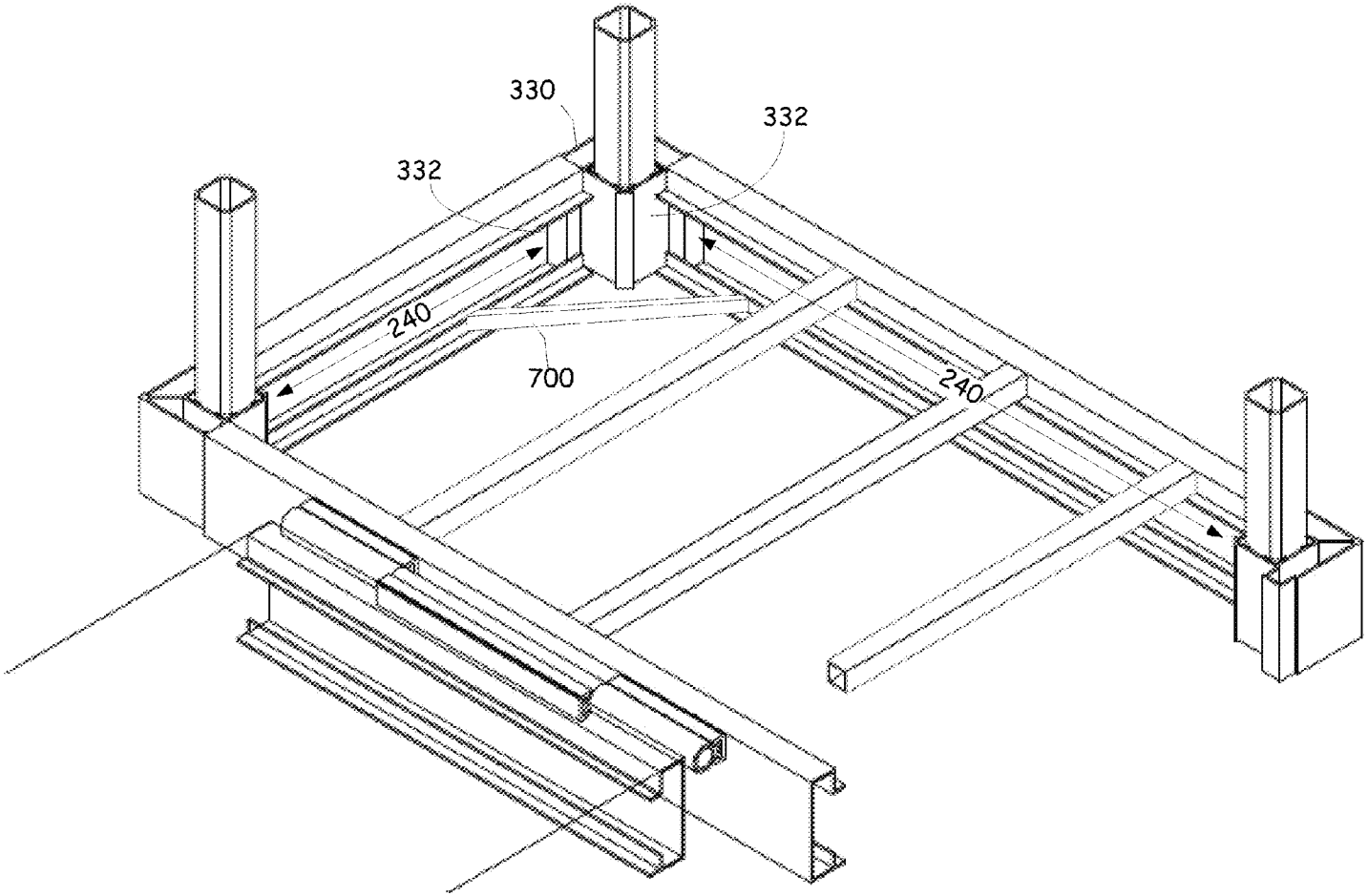
FIG. 1B is an assembled view illustrating several of the components illustrated in FIG. 1A interconnected to form a portion of a platform.
Figure 1C:
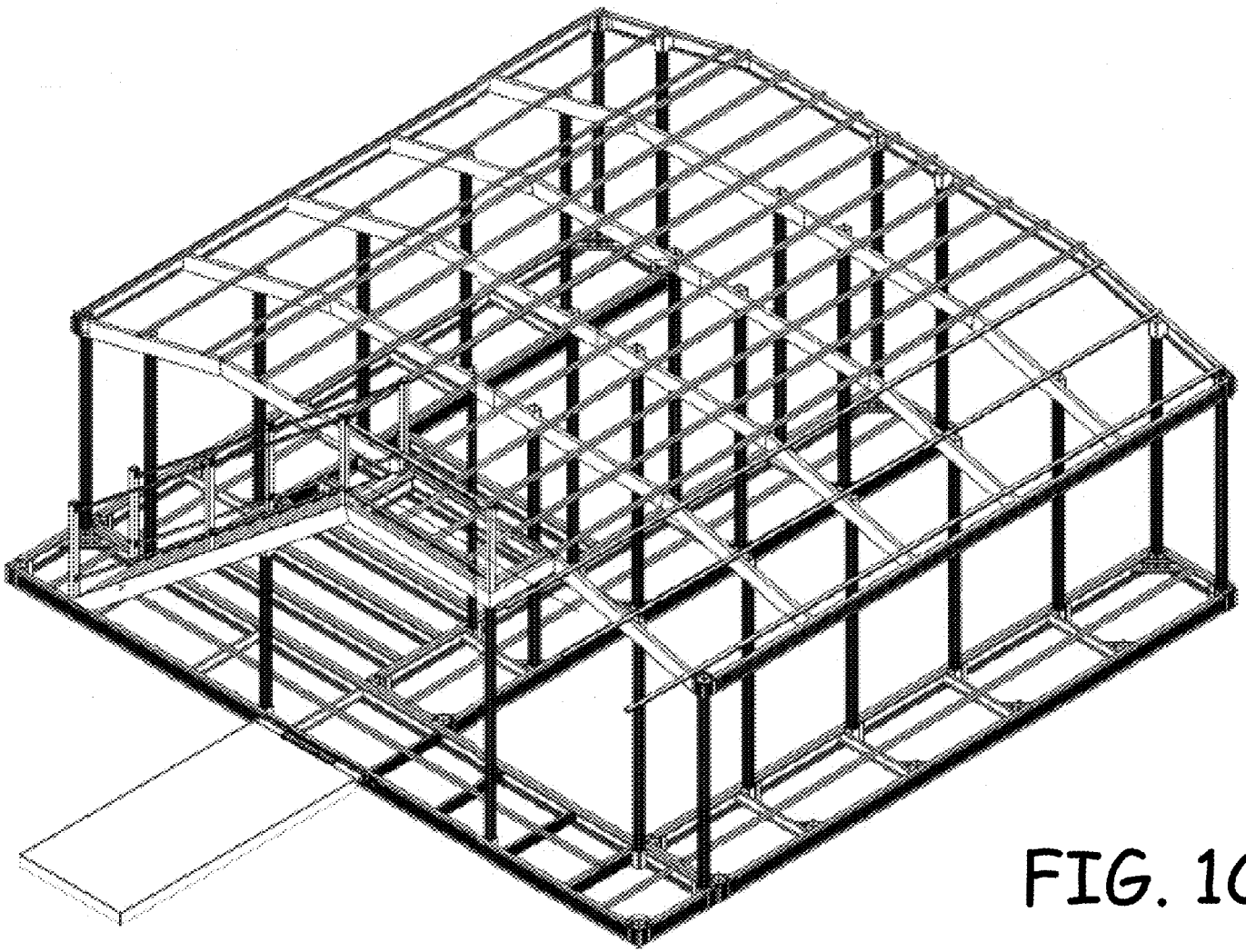
FIG. 1C is an assembled view of a docking structured built from various components that are included in an exemplary embodiment of the present invention.

FIG. 1B is an assembled view illustrating several of the components illustrated in FIG. 1A interconnected to form a portion of a platform. The various components illustrated in FIG. 1A and FIG. 1B are further described individually. FIG. 1C is a more complex illustration of a structure assembled using various components of an exemplary embodiment of the present invention. This structure shows that the various embodiments of the present invention can be used to not only construct decking, but also walls, roofs, stairways, railings, platforms and supporting structures.

Figure 2:
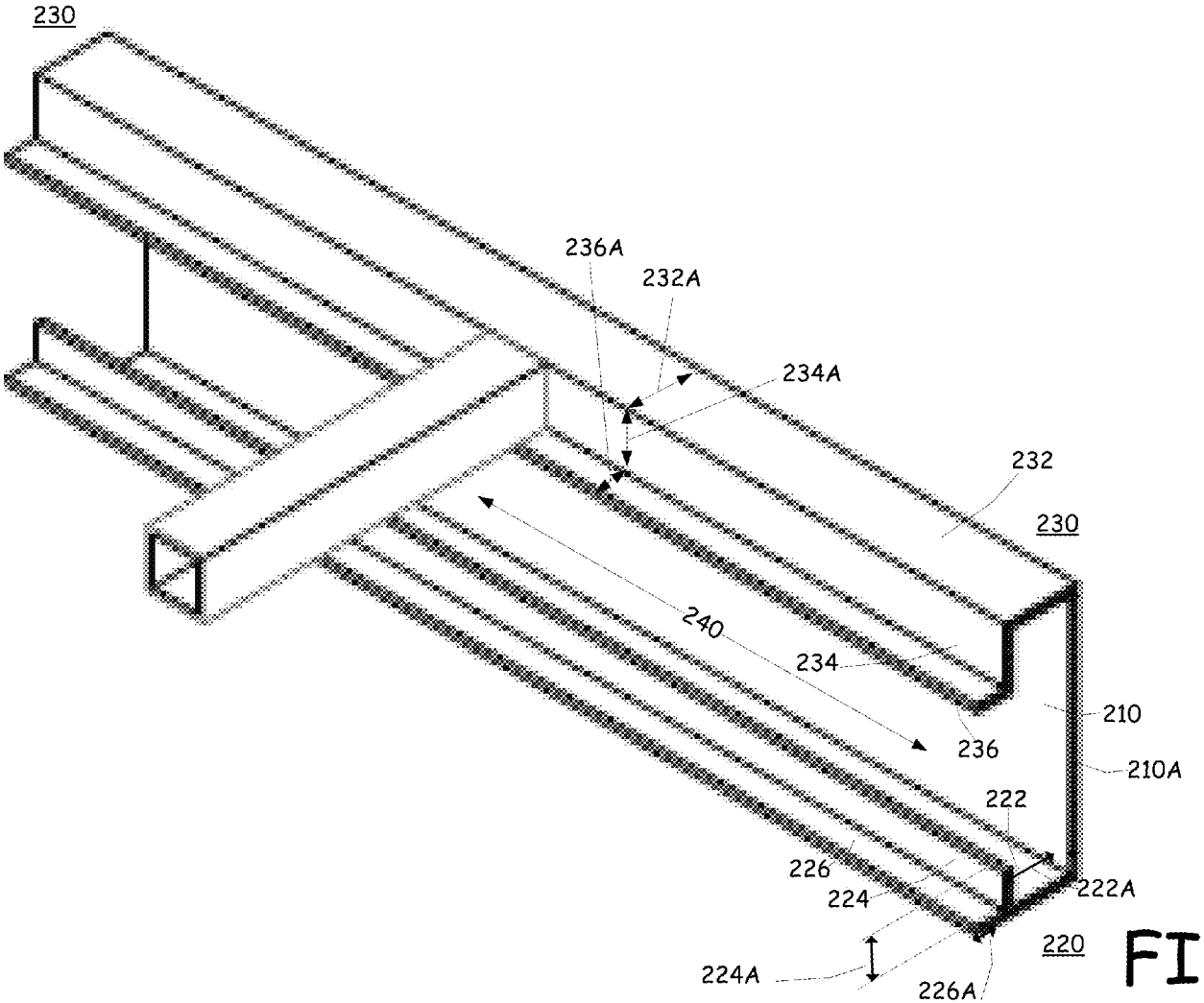
FIG. 2 is a perspective diagram illustrating further details of an exemplary embodiment of the of the fascia channel.

FIG. 2 is a perspective diagram illustrating further details of an exemplary embodiment of the of the fascia channel 30. The fascia channel 30 operates as a mainframe element similar to a joist or a beam in lumber construction in that is used to support decking and/or roofing, and is used to frame the overall structure. The illustrated fascia channel 30 has a main vertical wall 210 and includes a lower horizontal support member 220 and an upper horizontal support member 230.

The lower horizontal support member 220 includes a first horizontal component 222 that is attached, adjoined and/or is integral on one end to the lower end of the main vertical wall 210 and on the opposing end, to a vertical structure 224. The vertical structure 224 extends substantially parallel to the main vertical wall 210 in a direction towards the upper horizontal support member 230 and substantially perpendicular to the first horizontal component 222. Throughout this description, the terms substantially parallel and substantially perpendicular are used. It should be appreciated that unless otherwise specified, these are just non-limiting examples of the structure and are meant to be construed broadly, not within a rigid requirement. However, it should also be appreciated that employing parallel and perpendicular relationships between members may be included as aspects of exemplary embodiments of the present invention. In addition, the terms attached, adjoined, integral may be used throughout this description. When used in particular instances, it should be appreciated that although the particular term used may be presented as an aspect of an embodiment of the invention, that the other terms may also equally apply in alternate embodiments of the invention. For instance, in one embodiment, an extruded component may be described as having members that are integral to each other but, the members could also be adjoined or attached. Further, simply because one term is used, such as integral, it should not be used to imply that any particular fabrication technology is employed. For instance, integral members could be extruded, cast, welded, glued, bolted or riveted together, as a few non-limiting examples.

The lower horizontal support member 220 also includes a second horizontal component 226 that extends along the same plane as the first horizontal component 222 and is adjoined with the vertical structure 224 and the first horizontal component 222 at a common joint whereby the vertical structure 224 and the first horizontal component 222 and the second horizontal component 226 form an inverted T. In other embodiments, not illustrated, the vertical structure 224 may angle towards or away from the main vertical wall 210.

The upper horizontal support member 230 includes a first horizontal member 232, a vertical member 234 and a second horizontal member 236. The first horizontal member 236 is adjoined to the edge of the main vertical wall 210 at the distal end of the main vertical wall 210 from where the lower horizontal support member 220 is adjoined to the main vertical wall 210, and extends substantially perpendicular from the main vertical wall 210 in the same direction and parallel to the plane formed by the first and second horizontal components 222 and 226 of the lower horizontal support member 220. The vertical member 234 adjoins the first horizontal member 232 at a point distal to the main vertical wall 210, and extends perpendicular to first horizontal member 232 in the direction of the lower horizontal support member 220 and in the same plane as the vertical member 224. The second horizontal member 236 adjoins with the vertical member 234 distal to the vertical member 234 and first horizontal member 232 joint, extends perpendicular to the vertical member 234 and the main vertical wall 210 and extends away from the main vertical wall 210 substantially parallel to the plane of the first horizontal component 232.

In an exemplary embodiment, the main vertical wall 210 is 9 inches long at dimension 210A and has a thickness of 5/32 to 3/16 inches. The first horizontal component 222 of the lower horizontal support member 220 is 1 7/8th inches long at dimension 222A and 3/16th of an inch thick. The vertical component 224 of the lower horizontal support member 220 is 1 and 3/16th inches long at dimension 224A and 3/16th of an inch thick. The second horizontal component 226 of the lower horizontal support member 220 is 1 inch long at dimension 226A with a thickness of 1/8th of an inch.

Further, the first horizontal component 232 of the upper horizontal support member 230 is 2 1/4 inches at dimension 232A and has a thickness of 3/16 inches. The vertical component 234 of the upper horizontal member 230 is 2 1/8 inches at dimension 234A and has a thickness of 5/32 inches. Finally, the second horizontal component 236 of the upper horizontal member 230 is 1 inch long at dimension 236A and has a thickness of 5/32 inches.

Note, the dimension 232A is larger than the dimension 222A because 222A measures the internal cavity created between the main vertical wall 210 and the vertical member 224 of the lower horizontal component 220. The dimension 232A measures the outside dimension and thus, includes the 5/32 inch measurement of the main vertical wall 210 and the 3/16 inch measurement of the vertical component 234 of the upper horizontal component 230.

It should be appreciated that the fascia channel 30 forms a channel 240 in the non-limiting illustrated embodiment, that is 1 7/8$^{th}$ inches wide and 8 21/32 inches high. The channel is defined by the vertical component 224 and the first horizontal component 222 of the lower horizontal member 220, the main vertical wall 210 and the first horizontal component 232 and the vertical component 234 of the upper horizontal member 230. The recess created by the second horizontal component 236 and the vertical component 234 of the upper horizontal member 230 is suitable for receiving decking material or cross beams. Similarly, the recesses created by the second horizontal component 226 and the vertical component 224 of the lower horizontal member 220 and/or by the second horizontal component 236 and the vertical component 234 of the upper horizontal member 230 could be used to hold decking, flooring or other material to create an attractive ceiling appearance. It should be understood that the dimensions provided in this non-limiting example are for illustrative purposes only and although the illustrated dimensions may be considered to be a novel aspect of the present invention, the present invention is not limited to the illustrated example. Thus, the measurements presented herein are non-limiting examples, and although the particular dimensions may in and of themselves be aspects of a novel embodiment, the measurements can have 20% tolerances or can be varied significantly for other embodiments. It should also be appreciated, that the structure of the fascia channel 30 provides additional strength over the standard c-channel used in the industry in both the vertical axis and the horizontal axis. Further, the shape of the fascia channel 30 provides reinforcement to each of the other components so that each weld is reinforced with structural load bearing members.

Figure 3:
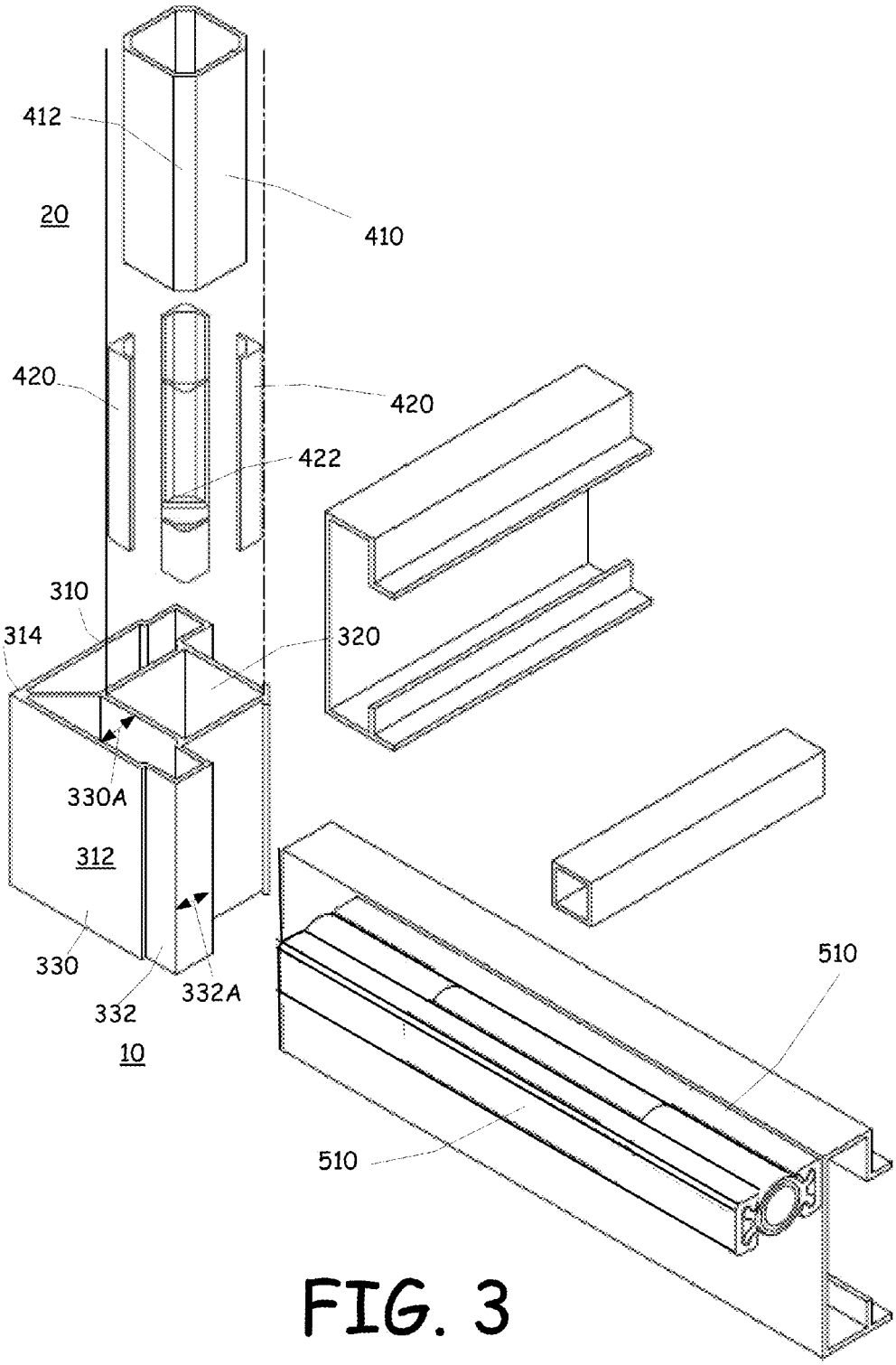
FIG. 3 is a perspective diagram illustrating further details of an exemplary embodiment of the corner connector and the post system.

FIG. 3 is a perspective diagram illustrating further details of an exemplary embodiment of the corner connector 10 and the post system 20. The corner connector 10 is designed to capture the entire profile of the fascia channel 30 providing substantial strength. The corner connector 10 includes two sides 310 and 312 that meet along spine 314 to define the outside of a corner. In the illustrated embodiment the two sides 310 and 312 meet at spine 314 to define a 90 degree corner but those skilled in the art will appreciate that the two sides can meet to form a corner having any angle. In fact, in one embodiment the two sides 310 and 312 may be placed end to end to form a non-corner or a straight connector piece. In other embodiments, the corner may cover the range of acute and obtuse convex angles as well as acute and obtuse convex angles. The corner connector 10 is also shown as including a gusseted pocket or post receptacle 320 designed to receive a post or a post system 20. In the illustrated embodiment, the two sides 310 and 312 form a 90 degree angle with the post receptacle 320 being on the inside of the corner. However, it will be appreciated that the post receptacle 320 could exist, either instead of or in addition to, on the outside of the corner defined by the sides 310 and 312. Similarly, in an embodiment in which the two sides 310 and 312 are aligned in the same plane to create a straight connector piece, the post receptacle 320 could be on either side of the fixture and at any location along the exposed portions of the sides and multiple post receptacles could be included. Further, in some embodiments the corner connector 10 may not include the post receptacle 320 at all.

Each of the two sides 310 and 312 are similarly structured and as such, the details of only one side are described. The side 312 includes an exposed region 330 and an inserted region 332. In the illustrated embodiment, the two sides 310 and 312 of the corner connector 10 are hollow, however, it will be appreciated that the structure could be solid or include any of a number of cross beams internal to the hollow member. The exposed region 330 has a first thickness and the inserted region 332 has a thickness that is less than that of the exposed region 330. In the exemplary embodiment, the inserted region 332 is structured such that it will slide into the channel 240 of the fascia channel 30 defined by the openings or slots created by the first horizontal component 222, the vertical component 224 and the main vertical wall 210 of the lower horizontal support member 220 and the first horizontal component 232, the vertical member 234 and the main vertical wall 210. In a particular embodiment, the width of the exposed region 330 at dimension 330A is 2 and 15/32 inches and the width of the inserted region 332 at dimension 332A is 1 and 13/16 inches. Thus, in the described embodiment, the interior region 332 is 1/16th of an inch narrower than the channel 140 to allow the interior region 332 to easily slide into the channel. Further, the slight gap can help in wicking the weld joint. In a specific embodiment, the walls of the corner connector 20 are 3/16ths of an inch; however, those skilled in the art will appreciate that various embodiments can use varying dimensions.

As can best be seen in FIG. 1B, when the corner connector 10 is inserted into the fascia channel 30, the interior region 332 enters the channel 240 and the exposed region 330 butts up against the channel 240 opening. The corner connector 10 can be welded to the fascia channel 30 along the abutment between the exposed region 330 and the channel 240 opening, or bolts or other attachment devices can be used to secure the components into position. In addition, the interior region 332 of the corner connector 10 provides structural support for the fascia channel 30 as the first horizontal component 232 of the upper horizontal member 230 rests on the top surface of the interior region 332. In an exemplary embodiment in which the corner connector 10 and the fascia channel 30 are extruded, it will be appreciated that a substantial amount of support is provided by the interior region 332. Advantageously, this support greatly alleviates the weaknesses created by welding the corner connector 10 and the fascia channel 30 together.

It will be appreciated that the corner connector 10 maybe fabricated, constructed and delivered in long segments that can be cut as necessary to fit into fascia channel 30. Thus, in some embodiments, if fascia channels of differing sizes are provided (i.e., the main vertical wall 110 may have a dimension other than 9 inches such as a 12 inch beam, 8 inch beam, etc), the corner connectors 10 do not have to change at all, but rather can simply be cut onsite to the correct height. In a particular embodiment, the corner connector 10 is a full 14 pound/foot extrusion and operates to strengthen the most critical locations of a structure. Advantageously, various embodiments eliminate the butt-welded corner found on typical docs or corner brackets that have been cast.

Figure 4:
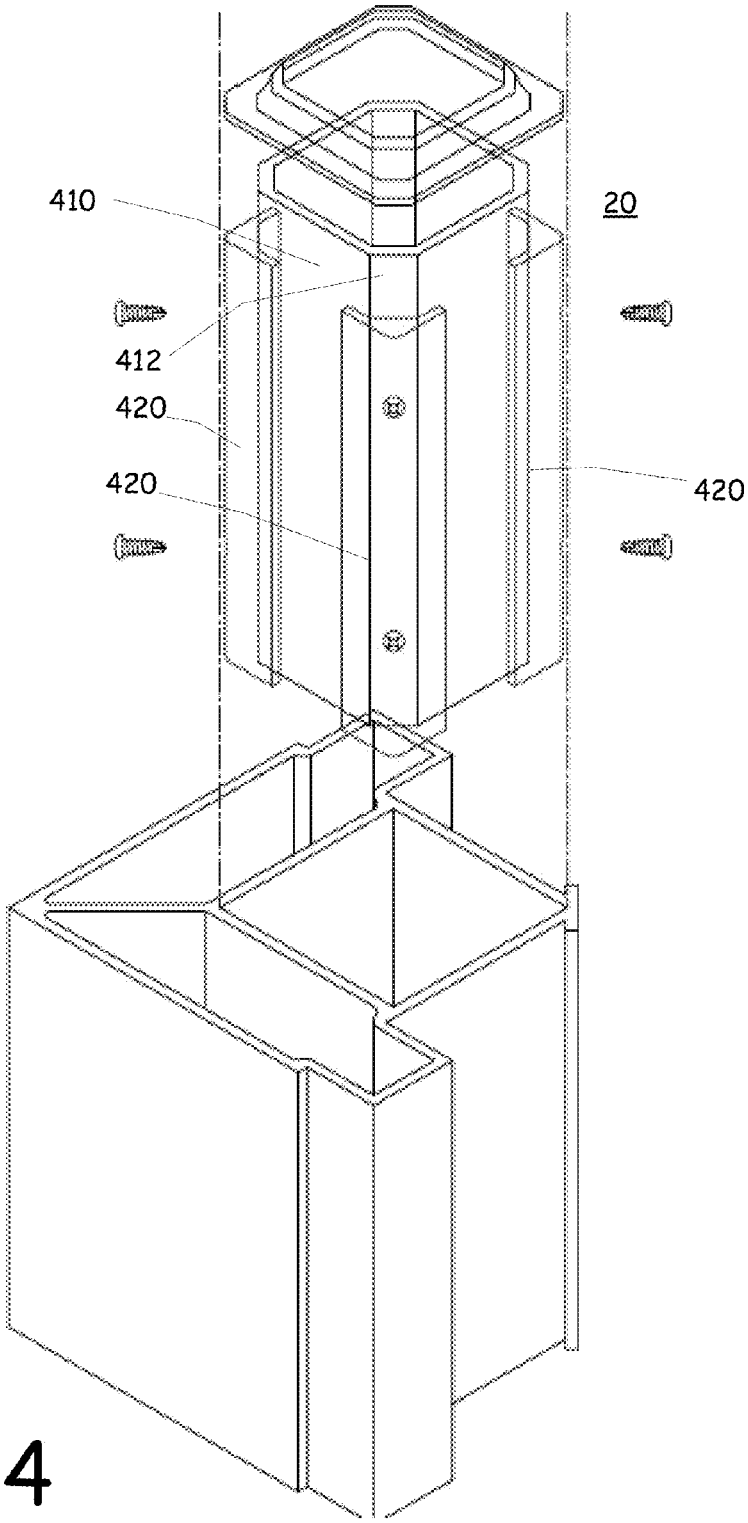
FIG. 4 is a perspective diagram illustrating further details of an exemplary embodiment of the post system.

FIG. 3 also provides a perspective diagram illustrating further details of an exemplary embodiment of the post system 20. FIG. 4 is a perspective diagram illustrating other details of an exemplary embodiment of the post system. The post system 20 includes a post 410 and one or more inserts or bushings 420. In the illustrated embodiment illustrated embodiment, the illustrated embodiment, the post 420 is a standard 4 inch×4 inch square tube with the corners of the post 420 being beveled to create an octagonal shape. It should be appreciated that the corners can be square, rounded or otherwise shaped and still be considered as embodiments of the present invention. The post is fabricated such that it can slide into the post receptacle 320 of the corner connector 20. In some embodiments, the post 410 can then be welded into the post receptacle 320. The inserts 420 can be inserted into the post receptacle 320 at the corners of the post 410. The inserts or bushings are typically manufactured of HDPE plastic or some polymer material and operate to keep the post 410 from directly contacting the post receptacle 320 to alleviate noise, and/or to secure the post 410 into position. Thus, one advantage of this aspect of an embodiment of present invention is that the inserts 420 operate to prevent noise created by the post 410 rubbing up against the walls of the post receptacle 320 for the dock, deck or gangways as is typical for floating docks. It should be appreciated that the corner post 20 can be used for connecting the base floor joists, the ceiling joists or as connecting middle flooring joists. In the first two scenarios, one or more plates may be welded or bolted across the opening of the post receptor 320 opposite from the end in which the post 410 is inserted—or at least offset from the opening in which the post 410 is inserted into the post receptacle 320. As such, the post can rest against this plate to hold the corner connector 20 in position. This support plate may be used in addition to or in lieu of welding the post 410 to the post receptacle 320. When the corner connector 10 is used to join the joist of a middle floor structure, the post 410 may extend completely through the post receptacle 320 and the post 410 can be welded or bolted to the post receptacle 320 or, one or more plates or stops can be affixed to the interior of the post receptacle 320 to enable a post 410 to be inserted into each side of the post receptacle 320 opening.

In one embodiment, the post 410 has a square cross-section with the corners beveled 412. In a particular embodiment, the post measure approximately 4 inches by 4 inches with approximately an 1 1/16th of an inch bevel. The post is hollow with the walls measuring a thickness of approximately 1/8th of an inch. The inserts 420, as illustrated, fit over the corners of the post 410. The inserts 420 have an internal portion that abuts against the corner of the post 410. Depending on the shape of the post (i.e., beveled, rounded, squared) the interior portion of the inserts 420 can be shaped accordingly. As best seen in FIG. 4, the insert 420 may include a stop 422 that rests against the edge of the post 410. The inserts 420 can be glued, screwed, strapped or otherwise connected to the post 410 to secure them in place. Typically, the inserts are the same length as the post receptacle 320, but can be slightly shorter or longer. In one embodiment of the invention one or more screw holes are provided in the corner of the insert 420 to facilitate attaching the insert to the post 410.

Figures 5A, 5B, 5C:
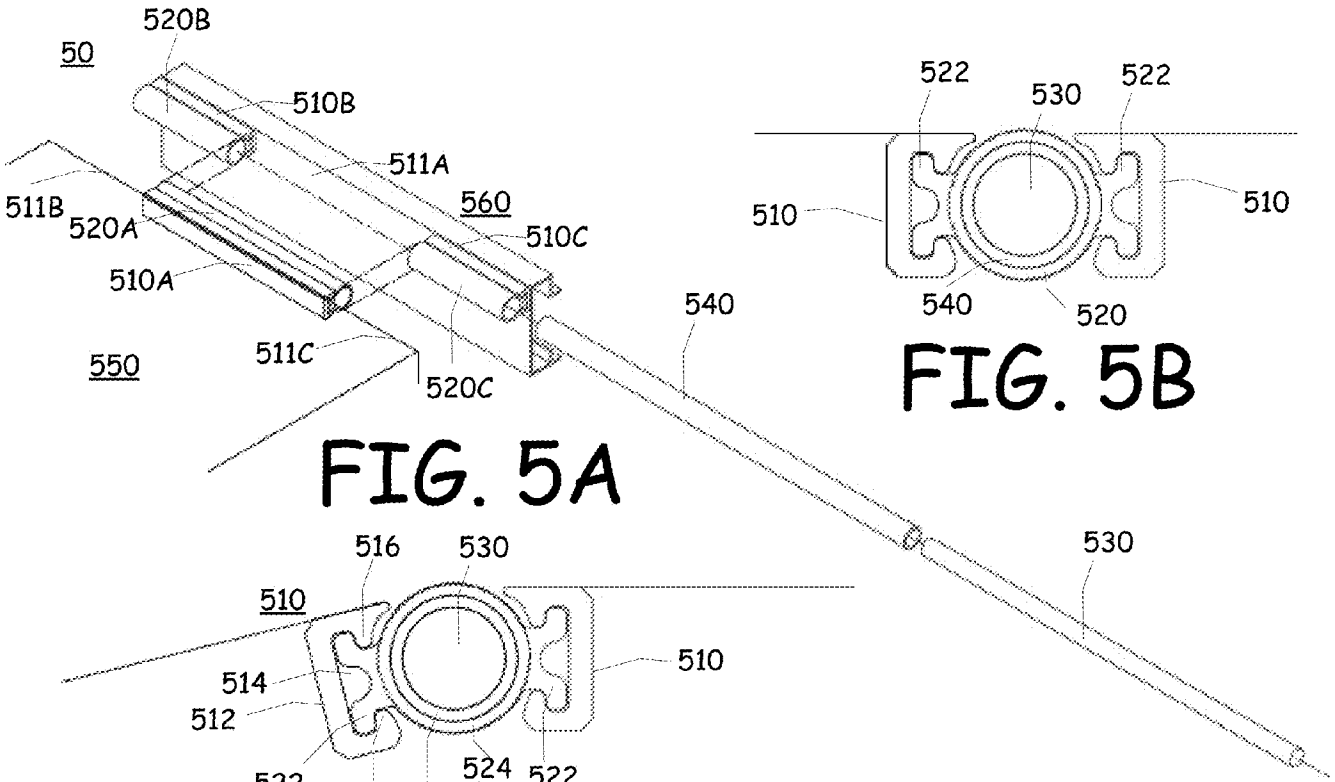
FIGS. 5A-5C are perspective diagrams illustrating further details of an exemplary embodiment of the hinge system 50.

FIGS. 5A-5C are perspective diagrams illustrating further details of an exemplary embodiment of the hinge system 50. The hinge system 50 is a heavy duty hinge and allows for flexibility in the attachments of portions of a docking system and is particularly beneficial in a floating dock structure, mounting gangways to a floating dock, doors, trapdoors, etc. The hinge system 50 includes platform mounts 510, hinge mounts 520, hinge pin 530 and hinge sleeve 540.

The platform mounts 510 are mounted to the sides of a platform, door, panel or structure that is to be joined together to another structure. In one embodiment, the platform mounts 510 are mounted across the entire face or joint. This embodiment is best illustrated in FIG. 3 where two platform mounts 510 are mounted in parallel across a portion of the fascia channel 30 on one side and the other side is to be mounted to another surface. Advantageously, this embodiment of the invention alleviates gaps at the joints and creates a clean interface for foot traffic in that the platform mounts 510 cover a majority of the gap. In another embodiment, the hinge mounts may be mounted only a portion of the face or joint. In the embodiment illustrated in FIG. 5A, the platform mounts 510 are mounted in an interleaved fashion (also described as a piano hinge) such that when the structures to be joined are aligned, the locations on one of the structures that include platform mounts 510 have a corresponding void on the other structure and visa versa. For instance, in FIG. 5A, structure 550 includes one length of the platform mount 510A, while the structure 560 includes two lengths of the platform mount 510B and 510C.

There is also a void 511A of the platform mount 510 on structure 560 which, as can be seen, corresponds to the existence of the platform mount 510A. Similarly, void 511B and 511C on structure 550 correspond with the platform mounts 510B and 510C respectively on structure 560. The platform mount 510 includes a mounting surface 512 that typically abuts against the structure. The platform mount 510 can be glued, bolted, screwed and/or welded to the corresponding structure. The platform mount 510 also defines a channel 514 that is further defined by fingers 516.

In the illustrated embodiment, the hinge mount 520 is shown as including a protrusion 522 that mates with the channel 514. Although the illustrated structure may in and of itself be considered an aspect of various embodiments of the invention, it should be appreciated that other shapes, sizes and structures may also be employed in other embodiments. The channel 514 is defined in such a manner as to allow a protruding portion of the hinge mounts 520 to be laterally slid into the channel and secured from being pulled away from the platform mount 510. For instance, in one embodiment of the invention that is not illustrated in FIGS. 5A-5C, a dovetail type of connection can be used between the platform mount channel 514 and the hinge mount 520.

Regardless of the structured used for the platform mounts 510, the hinge mounts 520 are sized or configured to be installed in a staggered manner (so as to correspond with the platform mounts 510 in FIG. 5A) and only exist on one side of the two structures being joined. Thus, in FIG. 5A, hinge mounts 520A, 520B and 520C correspond with platform mounts 510A, 510B and 510C respectively. In operation, the platform mounts 510 can be attached to the platforms and the hinge mounts 520 can be slid into the channels 514 of the platform mounts 510. The hinge mounts 520 can be welded into position or left free standing. The hinge mounts 520 also include a tube 524 (FIG. 5C) that is sized to receive the hinge sleeve 540 and the hinge pin 530. The hinge sleeve 540 is typically constructed of a polymer, plastic or other low friction material. The hinge sleeve 540 fits around the hinge pin 530 to facilitate its entry into the tube 524 of the hinge mount 520 as well as ease in the operation of hinge system 50. Typically, a single piece of the hinge pin 530 and the hinge sleeve 540 are inserted through the tubes 524 of the hinge mounts 520 to secure the two structures together. For instance, in FIG. 5A, a hinge pin 530 will be inserted into a hinge sleeve 540 and slid through the tubes 540 in hinge supports 520A, 520B and 520C thereby securing structure 550 to structure 560 in a manner that allows hinged movement between the structures. In one particular embodiment, the hinge pin 530 is fabricated out of stainless steel and is co-extruded with a sleeve 540 that is an HDPE plastic sheath to insulate the metal to metal contact and keep the hinge secure and quite for the lifetime of the dock. In the illustrated embodiment, the platform support 510 also includes a stop flange 511 that can be lengthened or shortened in various embodiments to control the amount of movement between the attached structures.

Thus, the hinge system 50 has been described as providing a flexible connection between two structures, such as two platforms or a platform and a gangway. However, those skilled in the art will appreciate that the hinge system 50 may be utilized in a variety of manners in the docking system including, as non-limiting examples, trap doors to provide access to the water or to a ladder that allows a user to climb down to the water, as a trap door between floors, as a roof access, as a trap door to an ice chest or a fish holding tank mounted below the floor of the docking system, as a door, as a false floor to cover over an unoccupied slip or as a covering for an occupied slip when the walls are higher than stored boat. Those skilled in the art will also appreciate other uses for the hinge system 50. A further advantage of the hinge system 50 is that it is durable, interlocking, self-aligning and quiet.

Figure 6:
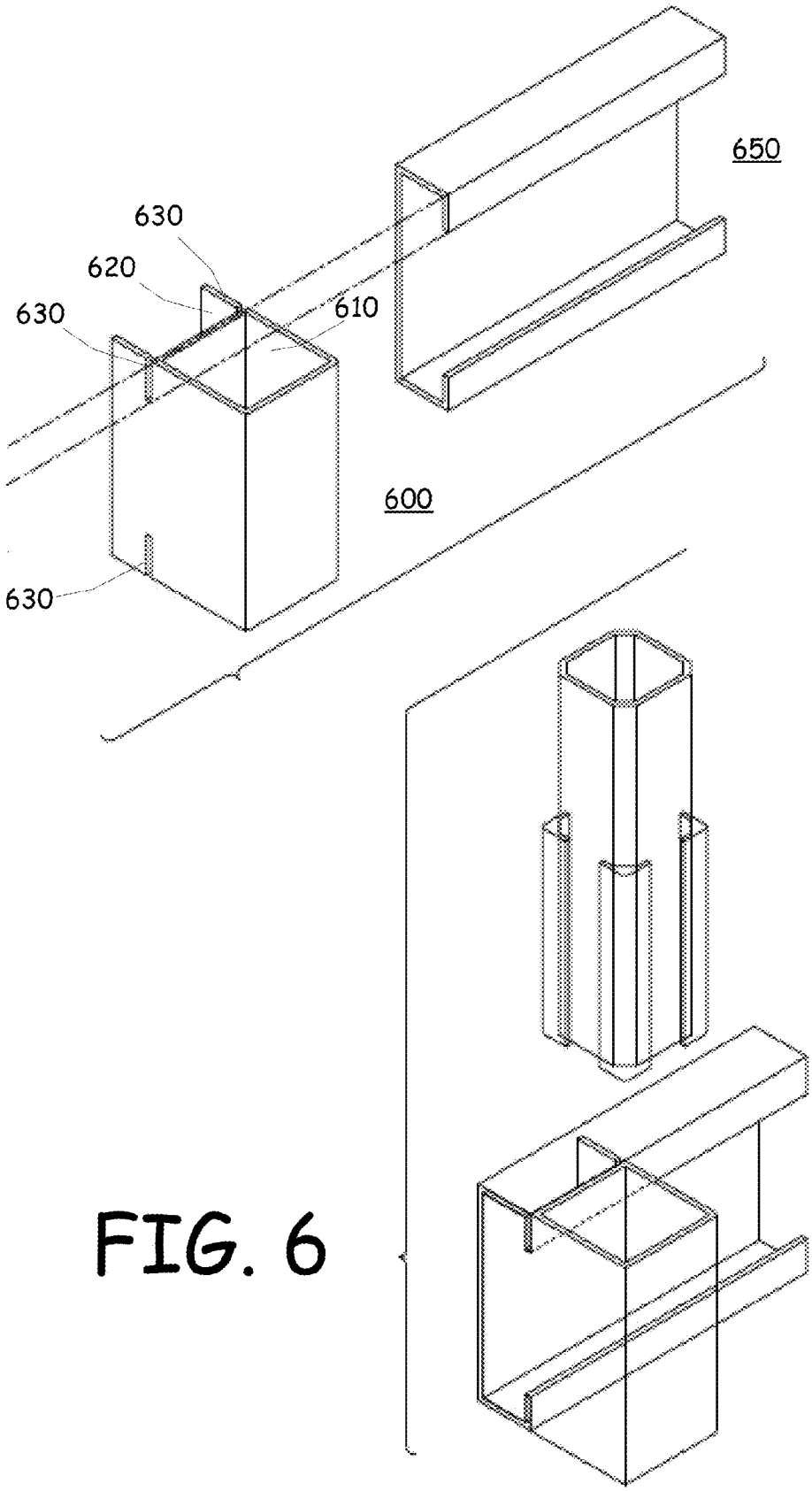
FIG. 6 is a perspective diagram illustrating a C-channel beam and post holder for the C-channel beam in an exemplary embodiment of the present invention.

FIG. 6 is a perspective diagram illustrating yet another component of that can be incorporated into various embodiments of the present invention. This component is a post holder 600. The post holder 600 can be mounted to a c-channel 650 or to an adapted fascia channel 30 and receives a post system 20 for providing support to the c-channel 650 or fascia channel. In a typical embodiment, the post holder 600 is extruded in long lengths and can be cut on-site as necessary. The post holder 600 includes a post receptacle 610 that is similar to the post receptacle 320 of the corner connector 10. Thus, the post receptacle 610 can receive a post system including 20 including the post 410 and the inserts 420. The post holder 600 also includes two flanges 620 that protrude from one common side of the post receptacle 610. Each flange 620 includes a slot 630 on opposing ends of the flange 620. In a typical operation, the post holder 600 is used to support the suspension of c-channels 650, such as a roofing structure. In addition, the post holder 600 can be used to join together two pieces of fascia channel 30. To attach the post holder 600 to the fascia channel 30, the second horizontal component 236 of the upper horizontal member 230 is cut away such that the vertical component 234 of the upper horizontal member 230 and the vertical component 224 of the lower horizontal member 220 slid into the slots 630 of the flanges 620. Thus, for a post holder 600 that has a width of 4 and $9/16^{th}$ inches, a portion of the horizontal member 236 of two fascia channels 30 to be joined together can be cut out at a length that is approximately half of 4 and $9/16^{th}$ inches. The fascia channels 30 can then be slid into the channels 620 and optionally welded into position. The slots 630 and the upper horizontal member 230 and the lower horizontal member 220 provide structural support for the fascia channel 30 above and beyond what is available from just a standard weld.

In either case, whether used to support a c-channel or a modified fascia channel, a post can then be inserted into the post receptacle 610 and welded into place, welded to a metal plate within the receptacle or both.

It will be appreciated that the components described interlock so that connections are supported by a framework "seat" and then welded into place. This redundant support adds significant strength and longevity to the dock and reduces the stress on critical weld points.

It will be appreciated that the components described can be used to assemble a dock, deck or other structure that is safe, efficient and structurally sound. Various components that may be included in embodiments of the present invention can comprise a standard set of components that can be easily inventoried in a supply store without overwhelming the retail companies with larger number of components. Furthermore, the various embodiments described can be utilized by a commercial contractor or by a do-it-yourself handy-man.

Another aspect that may be incorporated into various embodiments of the present invention is the use of gusset reinforcements. The gussets are in essences, cross members that extend between two assembled surfaces and provide additional structural reinforcement. For instance, a gusset may be extended between a fascia channel 30 or c-channels 650, and a support member. For example, in FIG. 1B a gusset 700 is shown as extending between to fascia channels 30 from the second horizontal component 226 of the lower horizontal support members 220. The gusset could also be mounted under the second horizontal component 226 or in a variety of other locations, including as non-limiting examples, between fascia channels on top of or underneath the second horizontal component 236 of the upper horizontal members 230, between similar surfaces of a c-channel, between an under surface of a fascia channel 30 or c-channel 650 and a post 20, etc.

As previously mentioned, a particular advantage of some embodiments of the present invention is that structural integrity above and beyond what is available from simply welding components together is achieved. Because of the adverse effects on the tensile strength of aluminum when welded, typical welded joints are susceptible to stress. However, embodiments of the present invention provide structural support in addition to welded joints to provide a more structurally sound structure. This is especially true in embodiments in which the components are extruded. Another advantage of embodiments of the present invention is that the components are designed such that extrusion is possible.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different components, aspects and/or features, not all of which are required in all embodiments of the invention. Some embodiments of the present invention utilize only some of the components, aspects and/or features or possible combinations of thereof. Variations of embodiments of the present invention that are described and embodiments of the present invention comprising different combinations of features noted in the described embodiments will occur to persons of the art. The scope of the invention is limited only by the following claims.

What is claimed is:

1. A dock construction system comprising:

a fascia component defining an interior channel having a particular cross-sectional shape and further comprising one or more integral lips along its length that extend away from the interior channel, wherein an integral lip is configured to receive and support an end of one or more cross beams;

a corner connector component including a first side and a second side joined at a desired angle, wherein at least one of the first side and the second side includes a support insert having a cross-sectional shape that corresponds to the particular cross-sectional shape of the fascia component interior channel, wherein when the support insert of the corner connector is inserted into the channel of the fascia component, the fascia component provides structural support for the corner connector; and one or more cross beams supported by one of the one or more integral lips of the fascia component.

2. The dock construction system of claim 1, further comprising gussets to provide additional strength.

3. The dock construction system of claim 2, wherein at least one of the one or more integral lips is configured to accommodate a weld to the gusset.

4. The dock construction system of claim 1, further comprising a fascia connector component configured to receive and abut the ends of two fascia components, wherein the fascia connector component comprises a post receptacle operable to receive a post and position it such that it is substantially perpendicular to the fascia components.

5. The dock construction system of claim 4, further comprising a post that is configured to be received by the post receptacle of the fascia connector component.

6. The dock construction system of claim 5, wherein the post includes one or more spacer inserts and the post receptacle of the fascia connector component has a cross-sectional shape that is configured to receive the post and the one or more spacer inserts.

7. The dock construction system of claim 6, wherein the spacer inserts are configured to dampen noise from being generated by the post making contact with the post receptacle.

8. The dock construction system of claim 5, wherein one or more of the fascia component, corner connector, cross beam, fascia connector component and post is extruded at a particular length and then cut on-site during construction of the dock.

9. The dock construction system of claim 1, wherein at least one of the one or more integral lips is configured to accommodate a weld to the one or more cross beams.

10. The dock construction system of claim 1, wherein the corner connector further comprises a post receptacle operable to receive a post and position it such that it is substantially perpendicular to the fascia component.

11. The dock construction system of claim 10, further comprising a post that is suitably sized for receipt by the post receptacle.

12. The dock construction system of claim 11, wherein the post includes one or more spacer inserts and the post receptacle of the corner connector component has a cross-sectional shape that is configured to receive the post and the one or more spacer inserts.

13. The dock construction system of claim 12, wherein the spacer inserts are configured to dampen noise from being generated by the post making contact with the post receptacle.

14. A dock construction system comprising:

a fascia component defining an interior channel having a c-shaped cross-section, wherein the fascia component has a first end and a second end; and a post holder component comprised of a post receptacle and two or more flanges, wherein:

the two or more flanges are configured to be received into the interior channel of the fascia component such that the post holder component may be positioned along a length of the fascia component between the first and second ends; and the post receptacle is operable to receive a post and position it such that it is substantially perpendicular to the fascia component.

15. The dock construction system of claim 14, further comprising a post that is configured to be received by the post receptacle of the post holder component.

16. The dock construction system of claim 15, wherein the post includes one or more spacer inserts and the post receptacle of the post holder component has a cross-sectional shape that is configured to receive the post and the one or more spacer inserts.

17. The dock construction system of claim 16, wherein the spacer inserts are configured to dampen noise from being generated by the post making contact with the post receptacle.

* * * * *